US010760212B2

(12) United States Patent
Lauer

(10) Patent No.: US 10,760,212 B2
(45) Date of Patent: Sep. 1, 2020

(54) ROPE AND METHOD FOR PRODUCING A ROPE

(71) Applicant: CASAR DRAHTSEILWERK SAAR GMBH, Kirkel (DE)

(72) Inventor: Bruno Lauer, Marpingen (DE)

(73) Assignee: CASAR DRAHTSEILWERK SAAR GMBH, Kirkel (DE)

( * ) Notice: Subject to any disclaimer, the term of this patent is extended or adjusted under 35 U.S.C. 154(b) by 32 days.

(21) Appl. No.: 15/555,254

(22) PCT Filed: Mar. 3, 2016

(86) PCT No.: PCT/DE2016/100098

§ 371 (c)(1),
(2) Date: Sep. 1, 2017

(87) PCT Pub. No.: WO2016/138893

PCT Pub. Date: Sep. 9, 2016

(65) Prior Publication Data

US 2018/0058003 A1 Mar. 1, 2018

(30) Foreign Application Priority Data

Mar. 4, 2015 (DE) ..... 10 2015 103 115

(51) Int. Cl.
*D07B 1/16* (2006.01)
*D07B 5/00* (2006.01)
(Continued)

(52) U.S. Cl.
CPC ..... *D07B 1/165* (2013.01); *D07B 1/0686* (2013.01); *D07B 5/007* (2013.01); *D07B 7/145* (2013.01);
(Continued)

(58) Field of Classification Search
CPC ..... D07B 1/165; D07B 1/0686; D07B 5/005; D07B 5/006; D07B 5/007; D07B 7/12; D07B 7/14; D07B 7/145
(Continued)

(56) References Cited

U.S. PATENT DOCUMENTS 2,067,405 A * 1/1937 Mayne ..... B60C 9/0007 57/7
2,369,876 A 2/1945 Warren
(Continued)

FOREIGN PATENT DOCUMENTS

DE 68925008 T3 12/1998
EP 1022377 A1 7/2000
(Continued)

OTHER PUBLICATIONS

Hanes Supply. Inc. "Wire Rope Glossary." Wire Rope Terms and Definitions, 2007, web.archive.org/web/20070524230028/http://www.hanessupply.com/glossary.asp. (Year: 2007).*

*Primary Examiner* — Khoa D Huynh
*Assistant Examiner* — Grace Huang
(74) *Attorney, Agent, or Firm* — Lucas & Mercanti, LLP; Klaus P. Stoffel

(57) ABSTRACT

A method for producing a rope, wherein fiber bundles are applied with a liquefied matrix material upstream of and/or at a twisting point to form fiber strands, and are embedded into the liquefied matrix material during stranding, by which fiber strands a fiber core of the rope is formed and wires or wire strands are wound about the fiber core. The matrix material of the fiber strands is hardened after the stranding, and the fiber strands are subsequently stranded directly with one another without further application to form the fiber core. Preferably the fiber strands are heated, during or after the stranding thereof to form the fiber core, so that the matrix material softens at least individual of the fiber strands, preferably all the fiber strands, softens and connects with the matrix material of another of the fiber strands, and is subsequently hardened, forming an integral bond with one another.

16 Claims, 4 Drawing Sheets

(51) Int. Cl.
*D07B 7/14* (2006.01)
*D07B 1/06* (2006.01)

(52) U.S. Cl.
CPC ..... *D07B 2201/1036* (2013.01); *D07B 2201/2019* (2013.01); *D07B 2201/2021* (2013.01); *D07B 2201/2057* (2013.01); *D07B 2201/2058* (2013.01); *D07B 2201/2065* (2013.01); *D07B 2205/10* (2013.01); *D07B 2205/201* (2013.01); *D07B 2205/205* (2013.01); *D07B 2205/2039* (2013.01); *D07B 2205/3003* (2013.01); *D07B 2205/3007* (2013.01); *D07B 2207/4027* (2013.01); *D07B 2207/4059* (2013.01); *D07B 2401/2015* (2013.01); *D07B 2401/2085* (2013.01)

(58) Field of Classification Search
USPC ..... 57/7, 217, 221, 223, 232, 258
See application file for complete search history.

(56) References Cited

U.S. PATENT DOCUMENTS 2,399,157 A * 4/1946 Warren, Jr. ..... D07B 1/005 57/220
3,778,994 A * 12/1973 Humphries ..... D07B 1/0693 57/214
3,800,522 A * 4/1974 Hughes ..... D07B 1/162 57/215
3,824,777 A * 7/1974 Riggs ..... D07B 1/144 57/214
3,874,158 A * 4/1975 Chiappetta ..... D07B 1/0686 57/214
4,197,695 A * 4/1980 Hughes ..... D07B 1/0673 156/433
4,887,422 A 12/1989 Klees et al.
5,060,466 A * 10/1991 Matsuda ..... D07B 1/025 57/12
6,631,609 B2 10/2003 Scheunemann
9,657,439 B2 * 5/2017 Lauer ..... D07B 5/00
2005/0160714 A1 * 7/2005 Delvael ..... A63B 51/02 57/232
2013/0220505 A1 * 8/2013 Pottier ..... D07B 1/062 152/451

FOREIGN PATENT DOCUMENTS

EP 1103653 A1 5/2001
EP 2441723 A1 4/2012
FR 1445157 A 7/1966
KR 20110078093 A 7/2011
WO 2008129116 A1 10/2008
WO 2012107042 A2 8/2012
WO 2012107842 A2 8/2012

* cited by examiner

ROPE AND METHOD FOR PRODUCING A ROPE

The present application is a 371 of International application PCT/DE2016/100098, filed Mar. 3, 2016, which claims priority of DE 10 2015 103 115.9, filed Mar. 4, 2015, the priority of these applications is hereby claimed and these applications are incorporated herein by reference.

BACKGROUND OF THE INVENTION

The invention concerns a method for the production of a rope, in which fiber bundles are coated before and/or at a twisting point with a liquefied matrix material in order to form strands and are embedded in the liquefied matrix material during stranding, a fiber core of the rope is formed by means of the fiber strands, and wires or wire strands are wound around the fiber core. The invention further concerns a rope producible by means of the method.

A method of the above-mentioned type is known from WO 2012/107042 in which fiber bundles or fiber strands formed from fiber bundles are wound onto a fiber core inside a container filled with the liquefied matrix material. Steel wire strands are either directly stranded onto a fiber core produced in this manner or stranded onto a sheath provided on the fiber core.

SUMMARY OF THE INVENTION

The object of the invention is to improve a method of the above-mentioned type such that ropes of relatively low weight with improved mechanical properties can be produced.

According to the invention, this object is achieved in that after stranding, the matrix material of the fiber strands is solidified and the fiber strands for forming the fiber core are then directly stranded with one another without further coating.

By means of the method, it is possible in a simple manner to produce a fiber core, the fiber bundles of which are preferably completely embedded in the matrix material and thus protected against breakage. More particularly, compared to the method according to WO 2012/107042, in which stranding takes place inside the container and is accordingly complex, the method is considerably simpler. Instead of coating the fiber strands with the matrix material in forming the fiber core, the fiber bundles are embedded in the matrix material only during production of the fiber strands. In order to form the fiber core, which can form the core of a strand of the rope or a core of the rope, the fiber strands can be wound using conventional stranding methods and conventional equipment intended for this application after solidification of the matrix material.

As explained below, the method allows the production of the fiber core with a relatively large diameter and a relatively complicated structure that ordinarily cannot be formed or can be formed only with great difficulty in stranding inside the container. Compared to production of the fiber core from fiber strands that do not have embedded fiber bundles, the method according to the invention has the advantage that handling of the fiber strands is substantially simpler and the produced fiber core shows improved mechanical properties because of the embedding of the fiber bundles. As the matrix material protects the fibers or the wires, bonds them to one another and transfers any forces generated to them, greater numbers of bending cycles in particular can be achieved.

The matrix material is preferably composed of a thermoplastic that is liquefied by heating and solidified by cooling.

While it would be conceivable to use natural fibers, metal fibers, mineral fibers, glass fibers and/or carbon fibers for production of the fiber strands, synthetic fibers such as aramid or polyethylene fibers are used in the preferred embodiment of the invention.

A thermoplastic is preferably used as the matrix material. In addition to polypropylene, which is preferably used, other possibilities include polycarbonate, polyamide, polyethylene or PEEK.

The fiber bundles are advantageously sprayed with the matrix material or, as provided in a particularly preferred embodiment of the invention, immersed before and/or at the twisting point in the liquefied matrix material.

For this purpose, in an embodiment of the invention, the fiber bundles, as described for example in WO 2012/107042, are caused to absorb the liquefied matrix material by means of a preferably heatable container matrix material that surrounds the fiber bundles before and optionally at the twisting point. The container or the spraying device is preferably connected to an extruder, by means of which the matrix material is liquefied and conveyed to the spraying device or into the container.

In a particularly preferred embodiment of the invention, the fiber strands, during and/or after their stranding to form the fiber core, are heated such that the matrix material of at least individual of the fiber strands, and preferably all of the fiber strands, softens and binds with the matrix material of other of the fiber strands, and the fiber strands are then cooled, preferably in air or in a cooling fluid, to form an integral bond with one another.

A homogeneous composite fiber core is formed that shows improved mechanical properties compared to fiber strands that are loosely wound with one another. The method makes it possible to produce such composite fiber cores with large numbers of fiber strands that are integrally bonded with one another.

For forming the fiber core, the fiber strands are advantageously parallel-stranded or layer-stranded.

In layer stranding, the fiber strands may be stranded in various lay directions in order to influence torque occurring on loading of the rope. In this manner, a fiber core can be produced that itself is rotation-resistant or rotation-free. However, it is also conceivable to provide the fiber core with a specified torque in a targeted manner in order to adapt it to a torque generated by the outer wires or outer strands, for example in order to produce a rope that is overall rotation-resistant or rotation-free.

A rotation-resistant rope rotates only slightly under a load. In order to produce the rotation-resistant rope, the fiber strands and optionally the outer wires or outer strands are advantageously laid in such directions and lay lengths that the rotational characteristic is ≤one 360° rotation per rope length of 1000 d on lifting of a load that is equivalent to 20% of $F_{min}$, wherein d=nominal rope diameter $F_{min}$=minimum breaking strength of the rope.

Such a definition of the rotation-resistant rope can be found in the standard DIN EN 12385-3:2008-06.B.1.5 under a).

However, it has been found to be particularly advantageous, in production of the rotation-resistant rope, to lay the fiber strands and optionally the outer wires or outer strands in directions and lay lengths such that the rotational characteristic of the rope is ≤one 36° rotation per rope length of 1000 d on lifting of a load that is equivalent to 20% of $F_{min}$, and particularly preferably ≤one 3.6° rotation of the rope per rope length of 1000 d on lifting of a load that is equivalent to 20% of $F_{min}$.

The fiber core should advantageously be constructed according to the general construction law for spiral ropes, which is as follows:

$$1 + m + \sum_{i}^{n} (m + 6 * n)$$

where n=1, 2, 3, 4 . . .

m=2, 3, 4, 5 . . .

In parallel stranding, the fiber core can be composed of all conceivable rope constructions. More particularly, examples of rope constructions are Standard Seale, Filler, Warrington, Warrington-Seale, Seale-Seale, Seale-Filler, Seale-Warrington, Seale-Warrington-Seale.

It has been found to be particularly advantageous that by means of the method according to the invention, it is possible to strand the fiber strands for the production of the fiber core in long lay, in which the fibers in the fiber strands and the fiber strands in the fiber core are wound in the same direction. The inventor has found that such stranding, which was previously impossible because in long lay stranding, the fiber strands became wound up and accordingly lost their structure during stranding, can be carried out by means of the present method, in which the fiber bundles are maintained by the matrix material in the fiber core strand structure. Long lay stranded fiber strands generate greater torque on loading than regular lay stranded fiber strands. This can be advantageously utilized in adjusting the torque generated on loading. In this way, depending on the torque respectively required and generated by the respective fiber strands, one can select whether the fiber strands are stranded in long lay or regular lay.

It is understood that for this purpose, the fiber strands of the fiber bundles can be stranded in a clockwise (Z lay) or counterclockwise direction (S lay), and as needed, the respective fiber strand layer can be stranded of fiber strands in the Z lay or S lay direction.

In an embodiment of the invention, a sheath is provided on the fiber core. The sheath is preferably composed of the matrix material, but can also be composed of another material that also bonds to the matrix material or adheres thereto such that forces can be transferred between the fiber core and the sheath by the respectively formed bond or adhesion that are strong enough so that the bonding or adhesion holds during loading of the rope. For this purpose, the fabric advantageously shows material properties similar to those of the matrix material, and is preferably composed of the same class of plastics. If the sheath is composed of the matrix material, in production of the fiber strands, an amount of matrix material can be arranged in the fiber strands such that a layer of the matrix material forms on the fiber core on heating during stranding of the fiber core. Alternatively, the sheath can also be applied in an additional operation.

The sheath is preferably provided in a thickness sufficient to embed the wires or the wire strands, at least in sections. More particularly, the sheath is provided in a sufficient thickness that at least the wires or wire strands of inner layers of the rope are fully embedded in the sheath. It is understood that the sheath can also be provided in a thickness such that outer layers of the wires or wire strands are also inside the sheath, so that the sheath closes off the rope externally. The embedding also gives rise to an integral bond between an outer layer of the strand or the rope formed by the wires or wire strands and the fiber core.

While it would be conceivable to strand the wires or the wire strands onto the fiber core in a separate method in which the sheath of the fiber core is softened by heating, the wires or wire strands in the preferred embodiment of the invention are stranded onto the fiber core immediately after stranding of said fiber core during a period in which the matrix material is still soft.

In a further embodiment of the invention, the wires or the wire strands are preformed before stranding onto the fiber core, preferably into a helical or approximately helical shape, which they assume in the completed rope. The ropes produced with the preformed wires or wire strands show little or no internal stresses. They are cut-proof, i.e. the wires or wire strands do not unravel when they are cut.

Preforming is found to be particularly advantageous when the rope has only a single layer of wire strands, as the wire strands in this structure exert particularly strong force on the fiber core, and this force can be substantially reduced by preforming.

However, preforming of the wire strands can of course also be advantageous if the wire rope has two or multiple wire strand layers.

In the following, the invention is explained in further detail by means of embodiments and the attached drawings, which refer to these embodiments. The figures show the following:

DETAILED DESCRIPTION OF THE INVENTION

Figure 1:
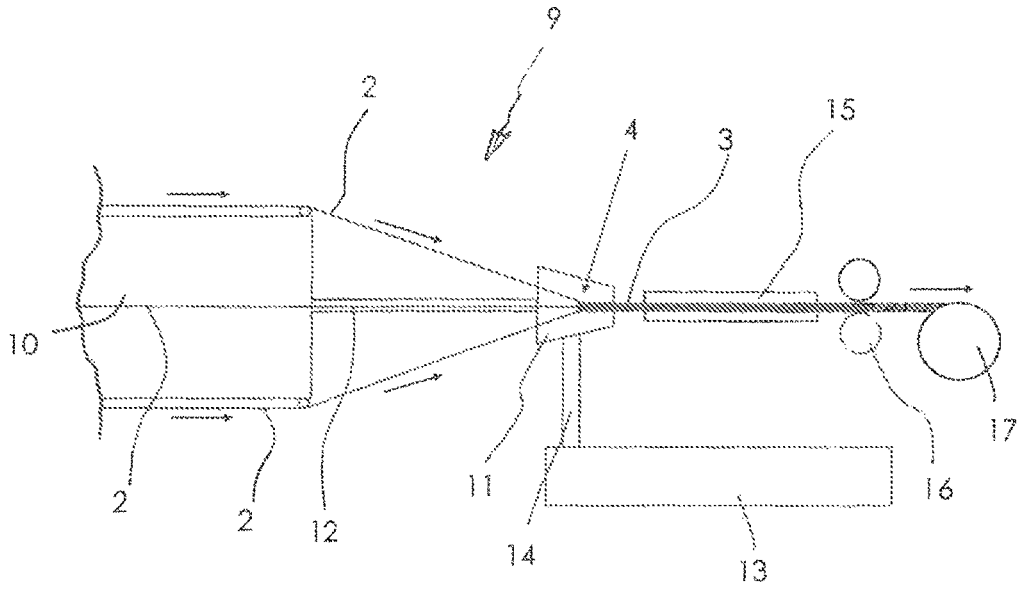
FIG. 1 schematically shows a device for carrying out the method according to the invention.

In order to carry out the method, wound bundles 2 of fibers, composed for example of aramid or polyethylene, are first stranded into a fiber strand 3 by means of the stranding device 9 shown in FIG. 1. For this purpose, the fiber bundles 2 are conveyed by means of a rotatable stranding basket 10 to a twisting point 4 at which they are wound into the fiber core strand 3. Spools, not shown here, onto which the fiber bundles 2 are wound, are arranged in a manner known per se on the stranding basket 10. In production of the fiber strand 3, the fiber bundles 2 are continuously unwound from the spools as the stranding basket 10 rotates. By means of rollers 16, the fiber strand 3 is pulled from the twisting point 4 and wound onto a drum 17 for further use.

Figure 2:
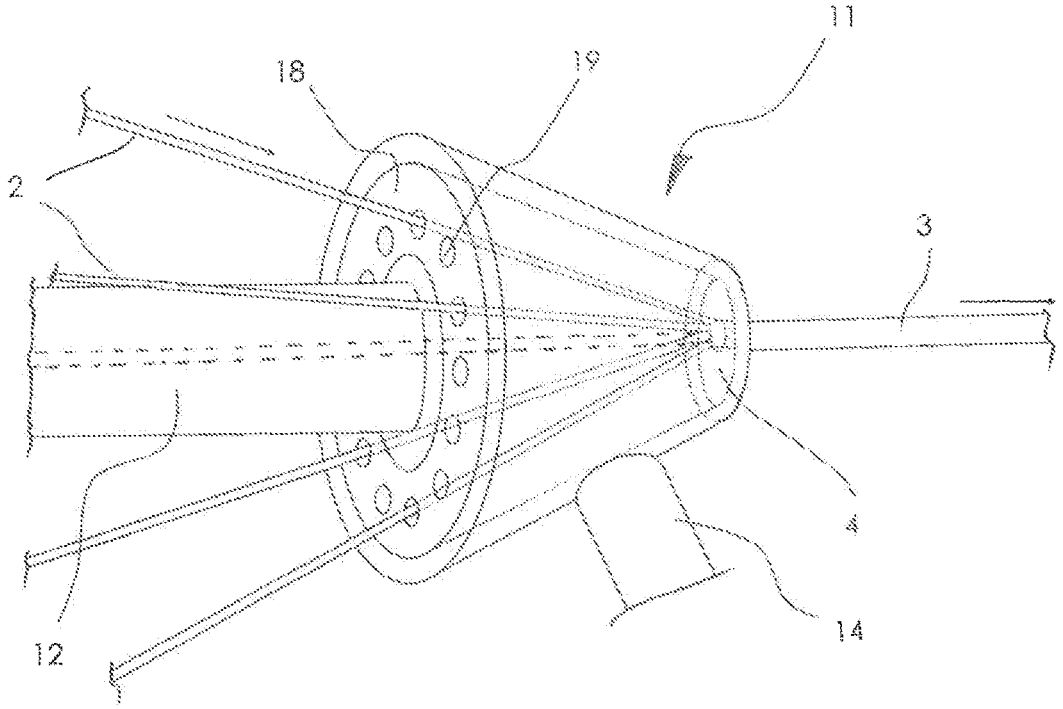
FIG. 2 shows a detail of the device according to FIG. 1 in an isometric view, FIG. 3 schematically shows a further device for carrying out the method according to the invention.

As shown in FIG. 1, and as can be seen more specifically in FIG. 2, the fiber bundles 2 are surrounded by a container 11 at the twisting point 4 to which a thermoplastic, such as polypropylene, can be fed via a heatable line 14 from an extruder 13. On its side facing the stranding basket 10, the container 11 is provided with a rotatable side wall 18 that has a plurality of openings 19 through which the fiber bundles 2 can be fed into the container 11. By means of a projection. 12, which is rigidly connected to the stranding basket 10, the rotatable side wall 18 is carried along by the stranding basket 10 when the stranding basket 10 rotates, A fiber bundle 2, which forms a strand core in the fiber strand 3, can also be fed through the projection 12 into the container 11.

On a side of the container 11 opposite the side wall 18, a further opening is provided, through which the fiber strand 3 composed of the fiber bundles 2 can be discharged from the container 11. The opening has a diameter and a shape that are equivalent to the diameter or shape of the fiber strands 3 to be formed.

In order to produce the fiber strand 3, the fiber bundles 2, in the respectively required number, arrangement, and size or in the required structure, are continuously wound with one another at the twisting point 4 with rotation of the stranding basket 10 and the movable side wall 18. In this process, the liquefied polypropylene is continuously fed into the container 11. This coats the fiber bundles 2 before and during stranding, so that the fiber bundles 2 in the fiber core strand 3 are embedded in the thermoplastic.

After the fiber strand 3 is discharged from the opening of the container 11, it is cooled in a water bath 15 or simply in the air in order to cool and thus solidify the thermoplastic, and it is then wound onto the drum 17.

Figure 3:
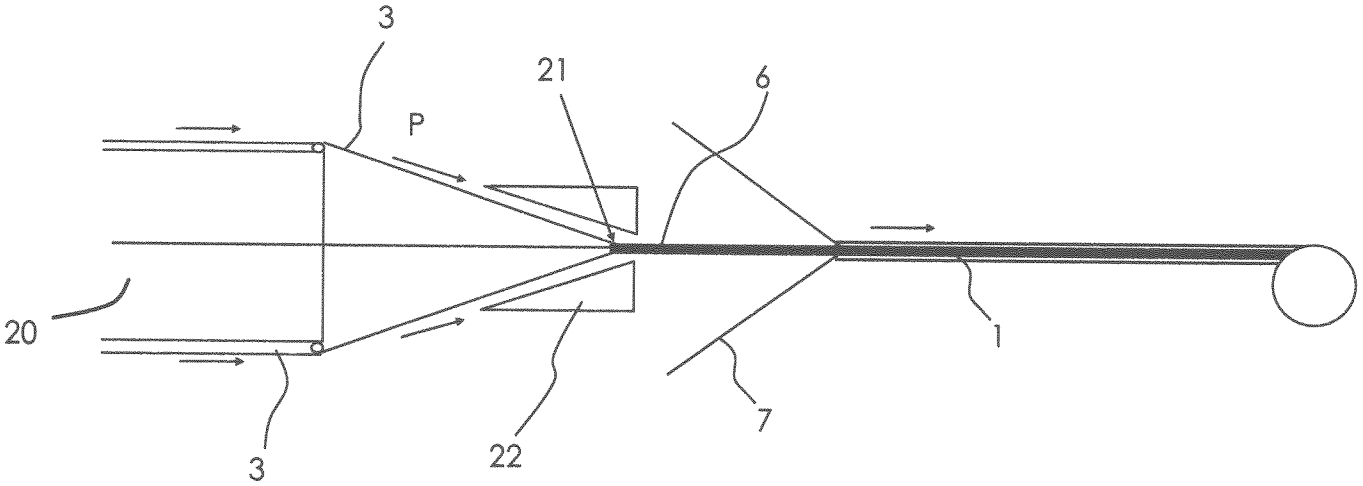

Using a number of the fiber strands 3 produced in this manner, fiber cores 6 see FIG. 3) of any desired structure can be produced using the conventional stranding devices by parallel stranding or layer stranding of the fiber strands 3, for example according to the above-mentioned general formation law for spiral ropes or in the mentioned rope constructions such as Seale, Filler, Warrington, etc.

FIG. 3 schematically shows a conventional stranding device 20 on which a heating device 22 is provided. By means of the heating device 22, the fiber strands 3 are heated before, at and/or after the twisting point 21 such that the thermoplastic in the fiber strands 3 becomes so soft that it melts together with other fiber strands 3 and forms a single-part fiber core 6 after cooling.

Figure 4:
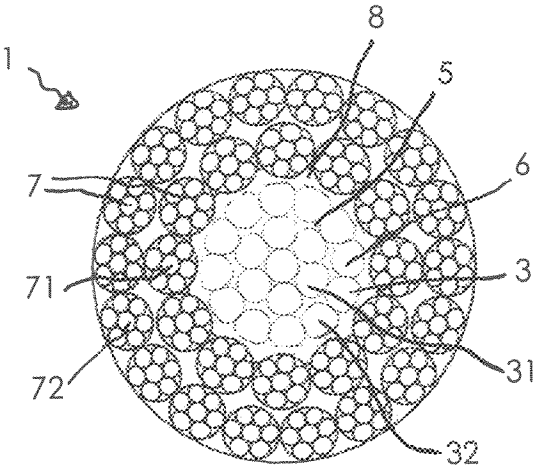
FIGS. 4-9 show sections of various ropes according to the invention.

In layer stranding, heating of the fiber strands 3 can be provided either in stranding of individual or all of the fiber strand layers 31, 32 or only in stranding of the last fiber strand layer 32 (cf. rope shown in section in FIG. 4).

After this, wire strands 7 are stranded onto the fiber core 6, for example as shown in FIG. 3 by means of a tandem stranding machine, and a rope according to the invention 1 is formed. Preferably the wire strands 7 are stranded onto the fiber core 6 for as long as the thermoplastic 5 remains soft. The wire strands 7 are then pressed into the thermoplastic 5, are embedded therein, and a positive-locking connection is formed between a wire strand layer 71 lying directly on the fiber core 6 and the fiber core 6.

Alternatively, the wire strands 7 can be stranded when the thermoplastic 5 of the fiber core 6 has already solidified. In this case, the wire strands 7 are only positioned on the fiber core 6.

Optionally, the wire strands 7 can be preformed prior to stranding, preferably into a helical or approximately helical shape, which they assume in the rope 1 when it is completed.

This makes it possible to produce the rope 1 with low internal stresses, and optionally even without any internal stresses.

In the production of the fiber strands 3, a sufficiently large amount of thermoplastic 5 can be provided in the fiber strands 3 so that during heating of the stranded fiber core 6, a sheath 8 of the thermoplastic 5 forms on the fiber core 6 in which wire strands 7 can be embedded.

Alternatively, an additional layer of thermoplastic 5 can be provided on the fiber core 6 in order to take up the wire strands 7.

FIG. 4 shows a sectional view of a rope 1 produced by means of the method described above, which has a fiber core 6 of fiber strands 3 of the same diameter and the same structure. In layer stranding, the fiber core 6 is stranded in a 1+6+12 structure, wherein a first layer 31 of six fiber strands 3 is stranded in a clockwise (Z lay) direction and a second layer 32 of 12 fiber strands 3 is stranded in a counterclockwise (S lay) direction. As the fiber strands 3 are stranded in the Z lay direction, the layer 32 is stranded in regular lay and the layer 31 in long lay.

As shown in FIG. 4, the fiber strands 3 are fully embedded in the thermoplastic 5. The layer of wire strands 7 lying on the fiber core 6 is embedded in a sheath 8, which has formed from the thermoplastic 5 and surrounds the fiber bundles 3 of the fiber core 6. The wire strands 7 are wound onto the fiber core 6 with a lay angle such that the torques generated by the fiber strands of the fiber core 6 and by the wire strands 7 cancel each other out on loading of the rope 1. The lay lengths of the fiber core 6 and the wire strands 7 can be adapted to each other such that rope 1 is rotation-resistant, for example with a rotational characteristic of one rotation of the rope <3.6/1000 d rope length on lifting of a load equivalent to 20% of $F_{min}$, or is rotation-free.

In the following, reference is made to FIGS. 5 through 9, in which parts that are identical or have the same action are designated with the same reference numbers as in FIGS. 1 through 4 and a letter is added to the relevant reference number respectively.

Figure 8:
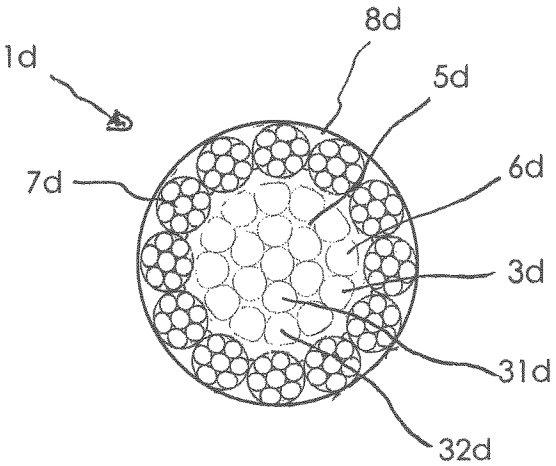

A rope 1*d* shown in FIG. 8 differs from that according to FIG. 4 in that only a single layer of wire strands 7*d* is provided, the wire strands 7*d* of the single layer are wound onto the fiber core 6*d* with a lay angle such that the torques generated by the fiber strands 3*d* of the fiber core 6*d* and by the wire strands 7*d* on loading of the rope 1*d* cancel each other out, and as described above, the wire strands 7*d* are preformed into a helical shape. Because of this preforming, on the one hand, the wire strands 7*d* exert relatively little force on the fiber core 6*d*. On the other hand, the rope 1*d* is cut-proof, i.e. it does not unravel under its own internal stresses when it is cut. The rope 1*d* is also rotation-resistant and can have the rotational characteristic described above for the rope 1.

Figure 5:
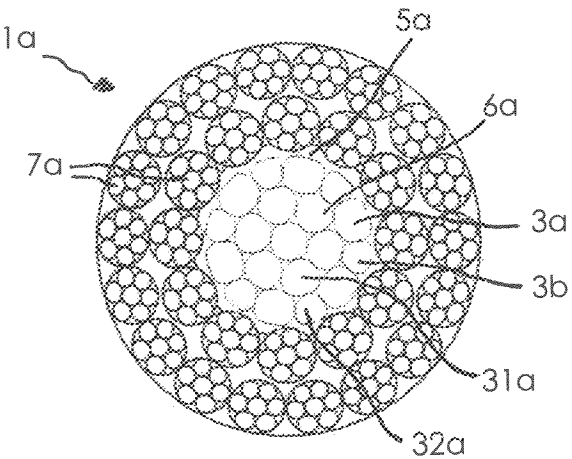

A rope 1*a* shown in FIG. 5 differs from the rope 1 according to FIG. 4 in that a fiber core 6*a* is parallel-stranded and has a 1+6+(6+6) structure (Warrington). Fiber strands 3*a*, 3*b* of an outer layer 32*a* of fiber strands 3*a* have different diameters. In the case of rope 1*a* as well, the lay lengths of the fiber core 6*a* and the wire strands 7*a* are adapted to one another such that the rope 1*a* is rotation-resistant, for example with a rotational characteristic of one rotation of the rope <3.6°/1000 d rope length on lifting of a load equivalent to 20% $F_{min}$, or is rotation-free.

Figure 9:
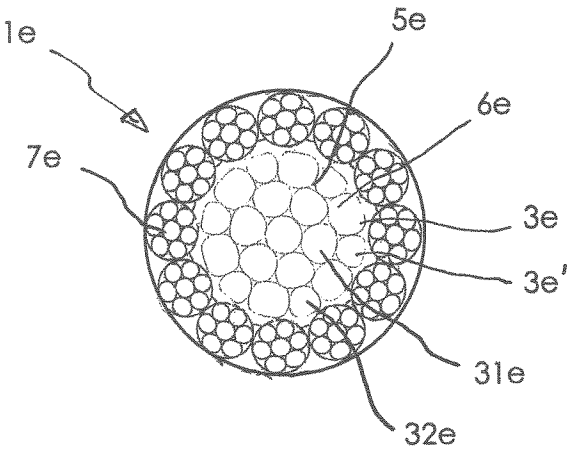

In contrast to the rope 1*a* according to FIG. 5, in the case of the rope 1*e* shown in FIG. 9, only a single layer of wire strands 7*e* is provided, the wire strands 7*e* of the one layer are wound onto the fiber core 6*e* in a lay angle such that the torques generated by the fiber strands 3*e*, 3*e*' of the fiber core 6*e* and by the wire strands 7*e* on loading of the rope 1*e* cancel each other out, so that the rope is rotation-resistant (and for example shows the rotational characteristic mentioned above for the rope 1*a*) or rotation-free, and the wire strands 7*e*, as described above, are preformed into a helical shape.

Figure 6:
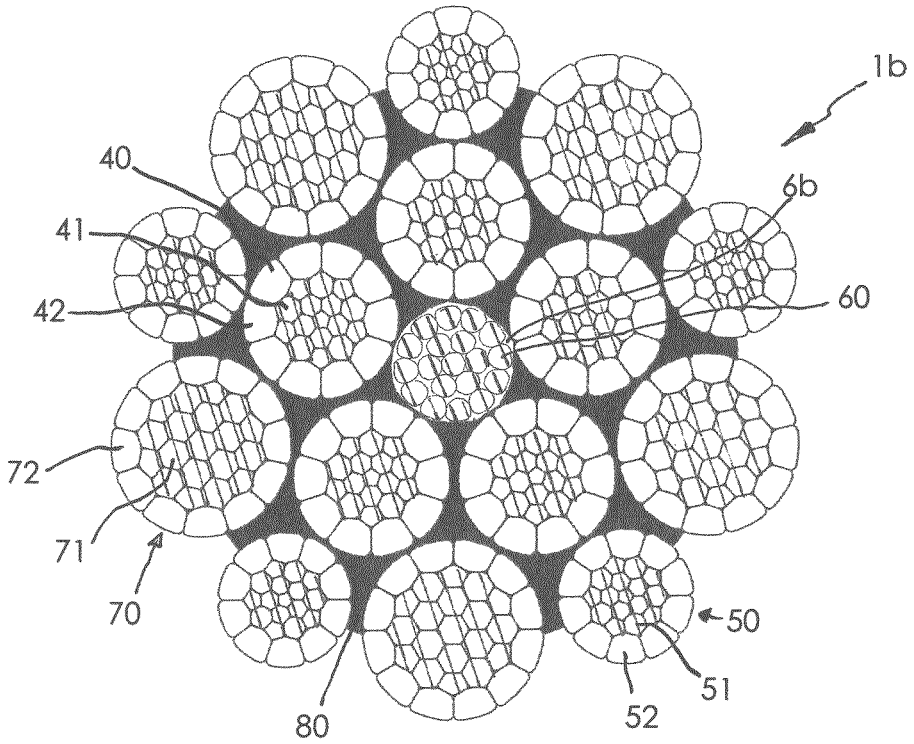

FIG. 6 shows a further rope according to the invention 1*b*, the fiber strands of which are indicated in the drawing by hatching. It has a core rope 6*b* with a 1+6+12 structure. In order to influence a torque generated on loading of the rope 1*b* by the core rope 6*b*, the individual layers of the core rope 6*b* of fiber strands 60 are layer-stranded in opposite lay directions. A strand layer is arranged on the core strand 6*b* that has five strands 40 having a 1+5+(5+5)+10 structure, wherein only the outer layer of the strands 40 is composed of steel wires 42 and the inner 1+5+(5+5) structure is formed by fiber strands 41. The strands 40 are compacted as a whole, for example by hammering.

An outer layer of outer strands 50 and 70 is wound around the strands 40. The outer strands 50 with fiber strands 51 and steel wires 52 have the same structure as the strands 40 and are also compacted, but have a smaller diameter. The outer strands 70 have a 1+6+(6+6)+12 structure. In the case of the outer strands 70 as well, a strand outer layer is formed by steel wires 72, and the strand interior, i.e. the 1+6+(6+6) structure, is composed of fiber strands 71. The outer strands 70 are also compacted.

All of the fiber strands 60, 41, 51, 71 required for formation of the rope 1*b* are produced by means of the method described above and heated during stranding in order to form a one-piece fiber core. In production of the fiber strands 41, 51, 71, an amount of thermoplastic, such as PEEK, is provided such that during heating after stranding onto the respective fiber core, a sheath of the thermoplastic is formed in which the outer steel wires 42,52,72 are embedded. During their stranding into the rope 1*b*, the core strand 6*b* and the strands 40,50,70 are embedded in a matrix material 80 composed of thermoplastic. The matrix material 80 may be composed of the same plastic in which the fiber bundles of the fiber strands 60,41, 51, 71 are also embedded (such as PEEK) or composed of another plastic, such as polycarbonate, which adheres to the thermoplastic and optionally bonds chemically thereto.

In the case of the robe 1*b* according to FIG. 6 as well, the fiber strands 60, the strands 40, and the outer strands 70 can be laid in such a manner that the rope 1*b* is rotation-resistant and for example has a rotational characteristic of one rotation of the rope <36°/1000 d rope length on lifting of a load that is equivalent to 20% of $F_{min}$.

Figure 7:
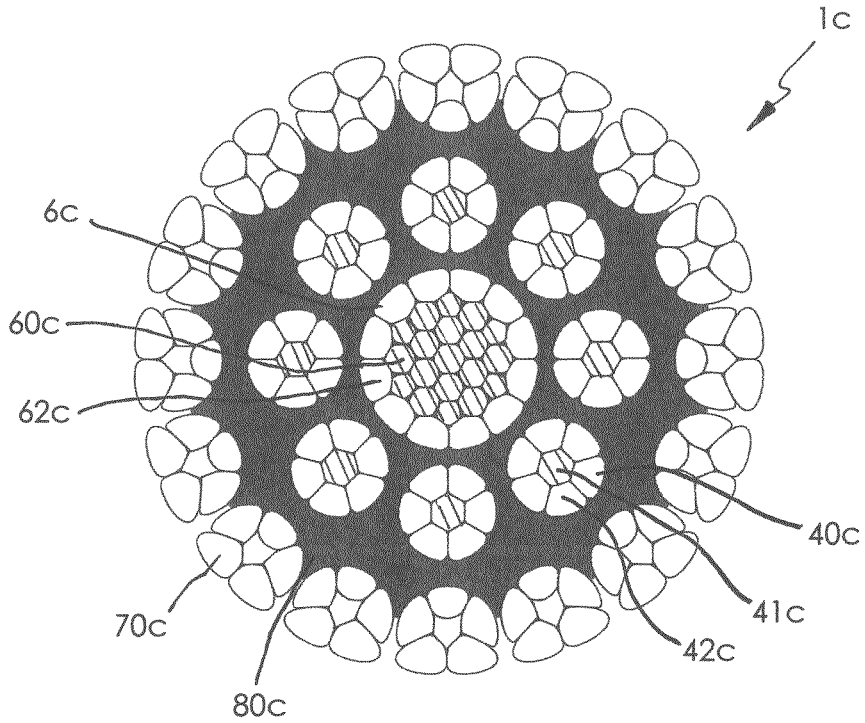

A rope 1*c* shown in FIG. 7 has a core rope 6*c* with a 1+6+(6+6)+12 structure. An outer layer of the core rope 6*c* is composed of steel wires 62*c*. The inner 1+6+6+(6+6) structure of the core rope 6*c* is formed by a fiber core, the fiber strands of which 60*c* produced by the method described above are parallel-stranded, and as described above, bonded to one another during stranding under heating.

Strands 40*c* wound around the core rope 6*c* show a fiber core composed of a single fiber strand 41*c* and steel wires 42*c* stranded thereon (1+6 structure). An outer layer of the rope 1*c* is formed by steel wire strands 70*c*.

In stranding of the rope 1*c*, the core strand 6*c*, the strands 40*c* and the outer strands 70*c* are embedded in a matrix material 80*c* of thermoplastic. The matrix material 80*c* is preferably composed of the same thermoplastic (for example polyamide) that was used for the production of the fiber strands 60*c*, 41*c*. The rope 1*c* has been compacted as a whole, for example by hammering.

In the rope 1*c*, the steel wires 62*c*, fiber strands 60*c*, the strands 40*c* and the steel wire strands 70*c* can be laid in such a manner that the rope 1*b* is rotation-resistant, and for example with a rotational characteristic of one rotation of the rope <18°/1000 d rope length on lifting of a load that is equivalent to 20% of $F_{min}$.

It is understood that the strands having wires of ropes 1*a*, 1*b*, 1*c*, 1*d*, 1*e* according to FIGS. 5 through 9 can also be preformed, as was discussed above for wire rope 1.

The invention claimed is:

1. A method for producing a rope, comprising the steps of:

coating fiber bundles with a liquefied matrix material at least one of before and at a twisting point when forming fiber strands;

stranding the fiber bundles to form the fiber strands and embedding the fiber bundles in the liquefied matrix material during stranding;

solidifying the matrix material of the fiber strands after the stranding;

subsequently stranding the fiber strands directly with one another without a further coating of matrix material to form a fiber core of the rope; and winding wires or wire strands around the fiber core, further including heating the fiber strands, during or after stranding thereof to form the fiber core, so that the matrix material softens at least individual of the fiber strands and binds to the matrix material of other respective fiber strands, and the fiber strands then solidify, forming an integral bond with one another.

2. The method according to claim 1, wherein all of the fiber strands are softened.

3. The method according to claim 1, including providing a sheath on the fiber core, the sheath being formed from the matrix material.

4. The method according to claim 3, wherein the wires or the wire strands are embedded in the matrix material of the sheath.

5. The method according to claim 1, wherein the fiber strands are parallel-stranded or layer-stranded to form the fiber core.

6. The method according to claim 1, wherein during layer stranding, the fiber strands are stranded in different lay directions in order to influence torque generated on loading of the rope so that the fiber core or the entire rope is rotation-resistant or rotation-free.

7. The method according to claim 1, including stranding the fiber strands in regular lay, in which fibers in the fiber strands and the fiber strands in the rope are wound in opposite directions, and in long lay, in which the fibers in the fiber strands and the fiber strands in the rope are wound in a common direction.

8. The method according to claim 1, wherein before stranding onto the fiber core, the wires or the wire strands are preformed into a helical or approximately helical shape, which the wires or wire strands assume in the finished rope.

9. The method according to claim 8, wherein only a single layer of the preformed wire strands is wound around the fiber core.

10. The method according to claim 8, wherein at least two layers of the wire strands are wound around the fiber core.

11. A rope, comprising a fiber core having fiber strands, wherein the fiber strands are formed from fiber bundles embedded in a matrix material, stranded with one another in the matrix material; and stranded onto the fiber core are wires or wire strands, wherein the fiber strands are directly stranded with one another in the fiber core without additional coating of matrix material, wherein the matrix material bonds the fiber strands of the fiber core to form an integral bond between the respective fiber strands and the fiber strands are fused to one another.

12. The rope according to claim 11, wherein a sheath is formed on the fiber core and the wires or wire strands are embedded in the sheath.

13. The rope according to claim 12, wherein the sheath is composed of the matrix material.

14. The rope according to claim 11, wherein the fiber strands of the fiber core are parallel-stranded or layer-stranded.

15. The rope according to claim 11, wherein the fiber strands are layer stranded in different lay directions in order to influence torque generated on loading of the rope so that the fiber core or the entire rope is rotation-resistant or rotation-free.

16. The rope according to claim 11, wherein the fiber strands are stranded in regular lay, in which fibers in the fiber strands and the fiber strands in the rope are wound in opposite directions, and in long lay, in which the fibers in the fiber strands and the fiber strands in the rope are wound in a common direction.

* * * * *